United States Patent [19]

Bolgert

[11] 4,306,468

[45] Dec. 22, 1981

[54] HANDLE ASSEMBLY

[75] Inventor: Edwin F. Bolgert, Kohler, Wis.

[73] Assignee: Kohler Co., Kohler, Wis.

[21] Appl. No.: 72,032

[22] Filed: Sep. 4, 1979

[51] Int. Cl.[3] ..... G05G 1/12

[52] U.S. Cl. ..... 74/548; 403/299; 292/348

[58] Field of Search ..... 74/548, 553; 292/348, 292/349; 403/299, 343

[56] References Cited

U.S. PATENT DOCUMENTS

| | | | |
|---|---|---|---|
| 350,714 | 10/1886 | Bardsley | 292/348 |
| 776,276 | 11/1904 | Voight | 292/348 |
| 3,250,148 | 5/1966 | Soles . | |
| 3,301,580 | 1/1967 | Greitzer . | |
| 3,396,604 | 8/1968 | Samuels et al. . | |
| 3,572,162 | 3/1971 | Gresham et al. . | |

*Primary Examiner*—Kenneth Dorner

*Attorney, Agent, or Firm*—Quarles & Brady

[57] ABSTRACT

A handle assembly for attaching a decorative handle to a turning stem is disclosed. In one embodiment, a stem cap having outer and inner spline surfaces, a stop surface, and carrying surface is placed over a turning stem, and the stem cap is secured to the turning stem using an attachment screw. A handle knob having interior mating splines is then brought down upon the top of the stem cap and an assembly ring is brought up from under the stem cap thereby sandwiching the stem cap. The handle knob and assembly ring are then connected, thereby completing the construction.

7 Claims, 4 Drawing Figures

HANDLE ASSEMBLY

BACKGROUND OF THE INVENTION (a) Field of the Invention

This invention relates to decorative handles which are attachable to control stems such as those found in plumbing fixtures. More specifically, it resides in a handle assembly which allows a decorative handle to be attached to a valve stem without requiring the use of an exterior access or screw hole in the handle for securing the handle to the valve stem.

(b) Description of the Art

The design of handles for plumbing fixtures has changed relatively little over the years. Normally, an exposed valve stem is provided with a set of external splines. A threaded screw hole is formed in the top of the stem. A typical handle will be provided with a corresponding set of splines which mate with the stem splines and slide over them. An attachment screw in the handle secures the handle to the stem by engaging the threaded hole in the stem. In order to make the attachment screw accessible so that the handle may be readily installed and removed, an access hole is normally made in the top of the handle. The attachment screw is thereby exposed.

For ease of cleaning and appearance, attempts were made to hide the access hole and the screw. To this end, the prior art developed special snaps or covers which could be placed over the access hole and removed when appropriate. Side set screws which passed through the handle neck instead of the handle top were also used.

However, the use of the special snaps or covers detracted from the decorative appearance of the top of the handle and was expensive, and the use of the side set screws detracted from the decorative appearance of the neck of the handle and was awkward.

More recently, U.S. Pat. No. 3,572,162, issued on Mar. 23, 1971 to Gresham et al. This patent disclosed an assembly which used a spring mechanism to hold a handle on the stem. A disguised external hole was provided in the handle to give access to the spring. However, this device suffered from reliance on a weak spring connection, the use of a complex mechanism, and the use of an access hole through which water and contaminants might enter the handle interior.

As such, it can be seen that the need existed for an inexpensive, simply designed handle assembly capable of connecting a decorative handle to a valve stem without the need for protrusions or holes through the handle exterior.

SUMMARY OF THE INVENTION

The invention resides in a simple construction which allows the attachment of decorative handles to control stems. In preferred form, an assembly ring is placed loosely over a stem. A stem cap is then inserted onto the top of the stem and attached thereto using an assembly screw or other suitable attachment means. The stem cap is thereby held against vertical movement and rotates with the valve stem due to corresponding mating surfaces on the exterior of the valve stem and interior of the stem cap. A decorative handle is then placed on the stem cap, such that the stem cap supports the handle. The handle interior mates with the stem cap exterior thereby causing the stem cap to rotate when the handle is rotated. The handle can be secured on top of the stem cap by connecting the assembly ring to the handle by a threaded engagement. The assembly ring may also be formed with a depending protective skirt.

Accordingly, the objects of the invention include:

a. providing a handle assembly of the above kind in which the handle may be attached to the stem without requiring a screw hole or other attachment mechanism passing through the handle exterior;

b. providing a handle assembly of the above kind in which the handle may be readily removed for inspection, cleaning, and repair;

c. providing a handle assembly of the above kind in which the handle and assembly ring protect and cover the internal elements of the assembly while retaining the decorative appearance of the assembly;

d. providing a handle assembly of the above kind which is cheaply constructed, provided with few parts, and which is made of structurally secure elements.

These and still other objects and advantages of the invention will be apparent from the description which follows. In the detailed description which follows, the preferred embodiment of the invention will be described in reference to the accompanying drawings. This embodiment does not represent the full scope of the invention, but rather the invention may be employed in other embodiments. Reference is made to the claims herein for interpreting the breadth of the invention.

DESCRIPTION OF THE PREFERRED EMBODIMENT

Figure 1:
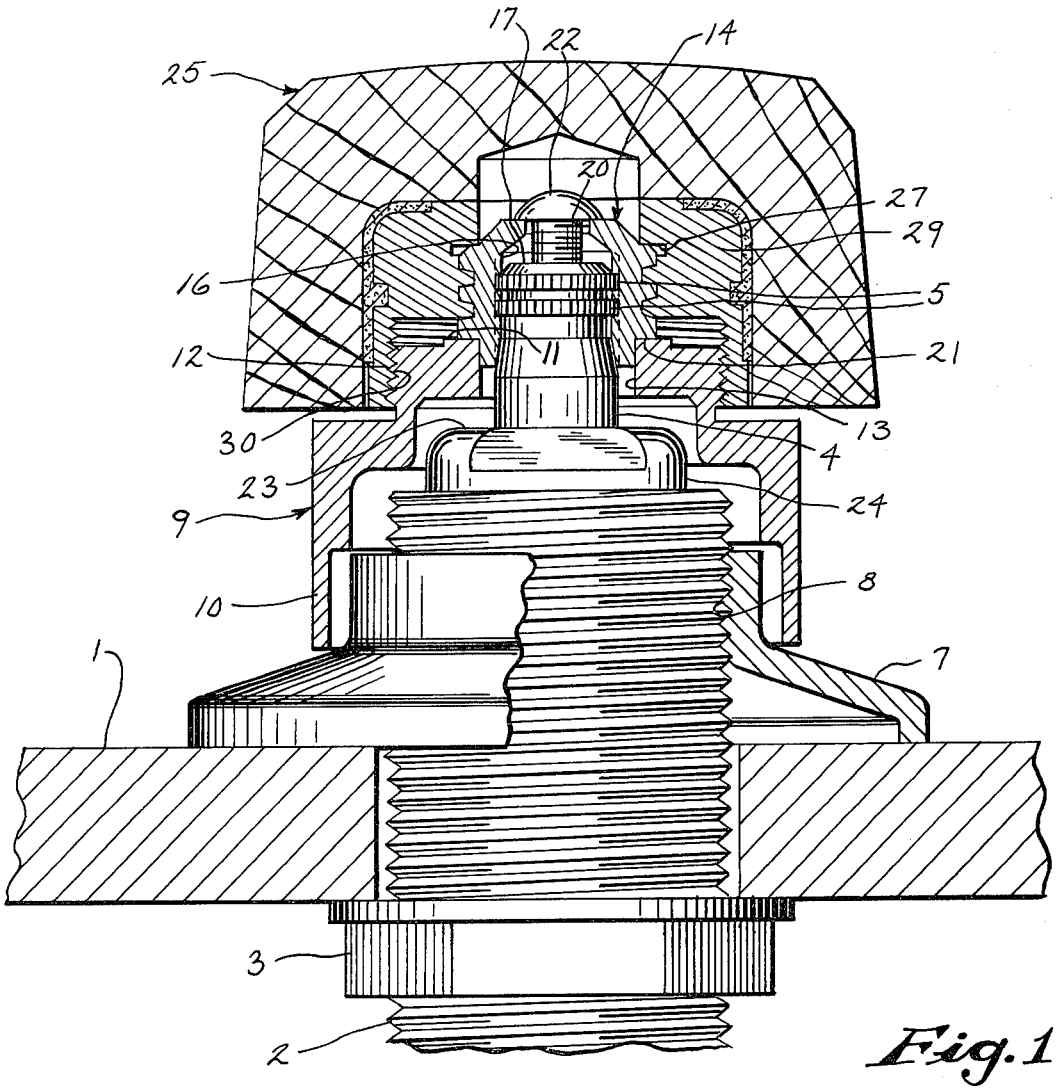
FIG. 1 is a partially sectioned view of a handle assembly embodying the invention attached to a valve stem.
Figure 2:
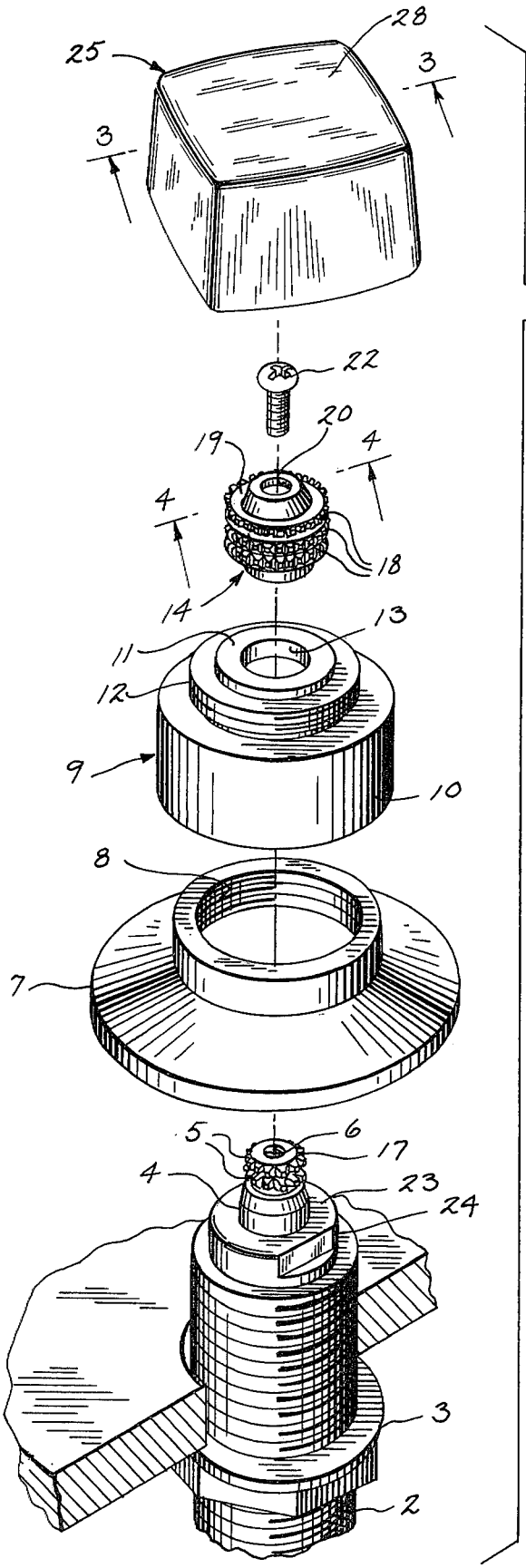
FIG. 2 is an exploded perspective view of the parts of the handle assembly of FIG. 1.

Referring now to FIGS. 1 and 2, a lavatory top 1 is shown through which a plumbing fixture, such as a valve for a faucet, protrudes. Only the upper part of the valve fixture is shown. A threaded neck 2 of a valve housing carries a threaded attachment nut 3 which holds the fixture against upward movement relative to the lavatory top 1. A conventional form of valve stem 4 protrudes upwardly from the housing neck 2 and is provided with a pair of splined circular lands 5. As shown in FIG. 2, the splines and lands form two horizontal rows of radially extending, truncated pyramidal projections. A threaded screw hole 6 is provided in the top of the stem 4, and an escutcheon 7 having inner threads 8 is screwed down upon the neck 2 to sandwich the lavatory top 1, as shown in FIG. 1. The general arrangement of these parts is a common form of construction in the art.

An assembly ring 9 is dropped loosely over the valve stem 4 and includes a skirt 10 that encircles the upper part of the escutcheon 7. The assembly ring 9 has an upper seating surface 11 at its top and a threaded shoulder 12, the significance of which will be discussed later. The lower skirt portion 10 of the assembly ring 9 has several interior counter bores of varied sizes which are of sufficiently large diameter to fit over the stem 4 and around the escutcheon 7. The assembly ring 9 has a central hold 13 in the shoulder 12 through which the stem 4 projects, with a space left between the surface of the hole 13 and the stem 4.

Figure 4:
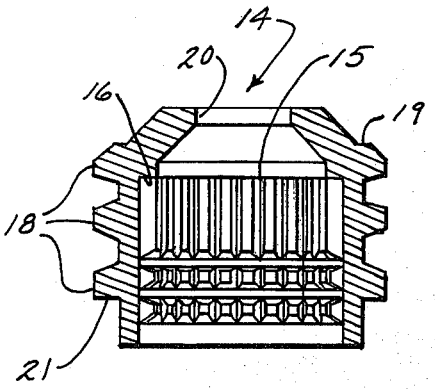
FIG. 4 is a cross sectional view of a stem cap forming a part of the handle assembly taken in the plane 4—4 indicated in FIG. 2.

Once the assembly ring 9 has been placed over stem 4, a stem cap 14 is fitted on the splined lands 5. As best seen in FIG. 4, stem cap 14 has internal splines 15 which mate and cooperate with the splined lands 5 of the stem 4. The stem cap 14 has an internal step 16 that sits upon a shoulder 17 of the stem 4 to arrest downward movement of the cap 14 when it is assembled onto the stem 4. The mating of the internal splines 15 with the splined lands 5 is such that as the stem cap 14 is rotated the stem turns in unison with cap 14 to operate the fixture.

Stem cap 14 has a set of three external lands 18 that are splined, and the uppermost land 18 is formed with an upwardly facing circular support surface 19. An attachment hole 20 is provided in the top of the stem cap 14, and a stop shoulder 21 faces downwardly in a position beneath the lands 18. Once the stem cap 14 has been placed over stem 4 and assembly ring 9, an assembly screw 22 is brought down through hole 20 in stem cap 14 and into the threaded hole 6 in stem 4, thereby securing the stem cap to the stem 4. In this configuration, the assembly ring 9 has some limited vertical movement between ledge 23 of packing nut 24 and the stop shoulder 21 on stem cap 14.

Figure 3:
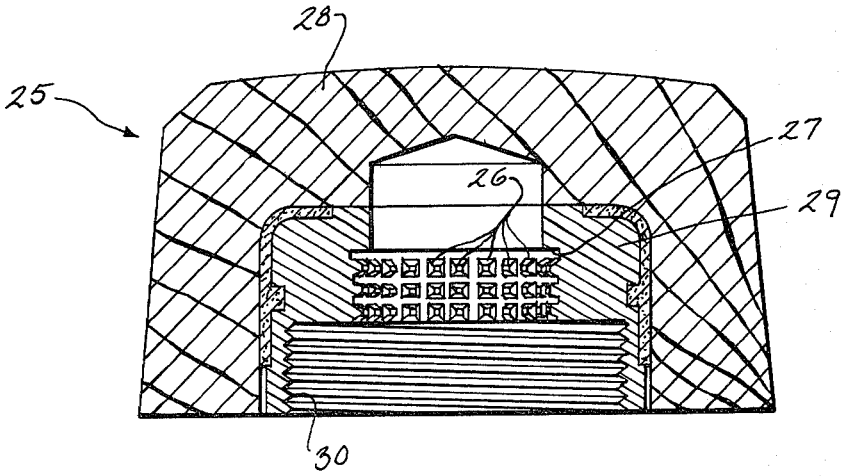
FIG. 3 is a cross sectional view of the handle of FIGS. 1 and 2 taken in the plane 3—3 indicated in FIG. 2.

To complete the assembly, a decorative handle knob 25 is brought down on top of stem cap 14. As best seen in FIG. 3, the interior of the handle 25 has an inner set of splines 26 that fit over and engage the stem cap exterior splined lands 18. The handle 25 has an internal downwardly facing abutment surface 27 that rests on the horizontal support surface 19 of the stem cap 14. The handle 25 is shown as being formed in two parts. The manually engageable body 28 is made of wood, and the second part is a metal insert portion 29 secured firmly within the wooden portion 28 by a suitable adhesive such as an epoxy. This insert 29 is the portion having the splines 26 and surface 27 for assembly with the stem cap 14. The insert 29 also has internal threads 30 that mate with the threaded shoulder 12 of the assembly ring 9.

Once handle 25 has been placed on stem cap 14, the assembly ring 9 is moved upwardly and threaded into the handle 25. The assembly ring 9 thus moves relative to the handle 25 along the axial direction of the stem 4, so that a working of the threaded engagement between the ring 9 and handle 25 brings the seating surface 11 of the ring 9 against the stop shoulder 21 of the stem cap 14 and the handle abutment surface 27 down against the stem cap support surface 19 to tightly clamp the stem cap 14 between the handle 25 and the assembly ring 9. All the parts are now firmly in place to provide a handle assembly for a faucet, or the like, in which there is no visible mounting screw, or screw cover on the handle.

It will be appreciated that the assembled device shown in FIG. 1 functions in a manner comparable to typical faucet handles. However, the handle 25 needs no external holes in order to provide access to an attaching screw. The handle 25 may therefore be formed with an integral uninterrupted exterior surface. When the handle 25 is turned, internal spline connections between parts force the stem 4 to rotate in the usual manner to control the associated valve and its fluid flow.

Assembly screw 22 prevents the handle assembly from moving in a vertical direction. Assembly ring 9 is free to rotate with the handle 25 without contacting stem 4, and prevents the handle 25 from moving upward from the abutment of surface 11 with stop shoulder 21. Handle 25 will not move downwards, as internal abutment surface 27 is in contact with the support surface 19. Should the assembly need to be dismantled, one need only unscrew assembly ring 9 downwardly away from the handle 25 until threads 12 are completely free of handle 25, thereby allowing the handle 25 to be removed up off stem cap 14. Screw 22 will then be exposed, and upon its removal the ring 9 can be removed to provide access to the nut 24. By loosening nut 24, the associated valve can be dismantled in usual fashion.

The handle body 28 may be formed of a decorative and exotic wood such as Zebrawood, an African hardwood with oak-like coloring and distinctive graining. Or, other decorative materials may be employed, both natural and synthetic. Because of the absence of any exposed mounting or assembly elements of the handle structure, a particularly attractive fixture is obtainable. Also, by making the handle 25 of two parts, the external, highly visible part may be selected of a material both pleasing to the touch and attractive to the eye, while the internal part connecting with the stem portions of the assembly can be of a metal or other suitable material having the requisite strength.

Thus, the invention provides an improved construction for attaching a decorative handle to a control stem. The assembly is simple and solid in its construction, inexpensive to manufacture, and prevents contaminants from entering the internal handle parts. While a preferred embodiment has been described above, it is readily apparent to those skilled in the art that a number of modifications and changes may be made without departing from the spirit and scope of the invention. Therefore, it is intended that the scope of the invention should not be limited by the description of the preferred embodiment, but only by the claims which follow.

I claim:

1. A valve handle assembly attachable to a rotatable valve stem comprising:

A stem cap that fits on the valve stem and is fixed axially relative thereto to rotate therewith, having an outer transversely facing surface configuration, a stop surface facing in one direction along said valve stem, and a support surface facing in the opposite direction along said valve stem;

a valve handle surrounding said stem cap having an inner transversely facing surfacing mating with said configuration for rotation with said stem cap and having an abutment surface seated against said stem cap support surface; and a mounting member around the valve stem, in threaded engagement with said valve handle, which moves relatively to said valve handle along said valve stem upon an assembly of the mounting member with said valve handle by working of said threaded engagement, said mounting member having a seating surface for seating against said stop surface of said stem cap for holding said stem cap between said handle and said mounting member.

2. A handle assembly for attachment to a stem comprising:

a stem cap having an outer mating surface, a support surface, a stop shoulder, and an inner attachment surface;

means for connecting said stem cap to said stem such that said inner attachment surface engages said stem for rotation therewith;

a handle surmounting said stem cap having an abutment surface for contacting said support surface to hold said handle from downward movement with respect to said stem cap, an inner mating surface for engaging and rotating with said outer mating surface on said stem cap, and threaded connection means; and an assembly ring carried under said handle and said stop shoulder of said stem cap, having threaded connection means for engaging and retaining said threaded connection means on said handle, and having a surface for contacting said stop shoulder of said stem cap such that said handle is retained against upward movement with respect to said stem cap.

3. A handle assembly in accordance with claim 2 wherein:

said outer mating surface on said stem cap includes a first set of splines; and said inner mating surface on said handle knob includes a second set of splines.

4. A handle assembly in accordance with claim 3 wherein said assembly ring includes a downwardly depending annular skirt section.

5. A handle assembly in accordance with claim 4 wherein said handle includes an integral non-metallic cover section and a metal interior portion.

6. A handle assembly attachable to a valve stem comprising:

an annular stem cap having a plurality of splines on its outer surface, a support surface on the top thereof, a stop surface on its bottom, and an inner splined surface, said stem cap being attachable to said valve stem with said inner splined surface engaging said valve stem;

a handle surmounting said stem cap having an abutment surface contacting said support surface, a plurality of splines on its inner surface engaging said plurality of splines on the outer surface of said stem cap, and internal threads; and an assembly ring carried under said handle and stop surface of said stem cap, having outer threads for engaging said inner threads on said handle, and having a seating surface for contacting said stop surface on said stem cap, whereby said handle is retained against upward movement with respect to said stem cap and is rotatable with said stem cap.

7. The handle assembly in accordance with claim 6 wherein said assembly ring includes a downwardly depending annular skirt.

* * * * *